US008946537B2

(12) United States Patent
Yaron

(10) Patent No.: US 8,946,537 B2
(45) Date of Patent: Feb. 3, 2015

(54) ELECTROMAGNETIC TRANSDUCER FOR STRINGED INSTRUMENT

(71) Applicant: Gil Yaron, Petach Tikva (IL)

(72) Inventor: Gil Yaron, Petach Tikva (IL)

( * ) Notice: Subject to any disclaimer, the term of this patent is extended or adjusted under 35 U.S.C. 154(b) by 41 days.

(21) Appl. No.: 13/923,034

(22) Filed: Jun. 20, 2013

(65) Prior Publication Data

US 2014/0373701 A1 Dec. 25, 2014

(51) Int. Cl.
*G10H 3/14* (2006.01)
*G10H 3/22* (2006.01)

(52) U.S. Cl.
CPC ..... *G10H 3/22* (2013.01)
USPC ..... 84/727

(58) Field of Classification Search
USPC ..... 84/726–728
See application file for complete search history.

(56) References Cited

U.S. PATENT DOCUMENTS

| | | | | | |
|---|---|---|---|---|---|
| 2,612,072 | A | * | 9/1952 | De Armond | 84/727 |
| 2,612,541 | A | * | 9/1952 | De Armond | 335/229 |
| 3,541,219 | A | * | 11/1970 | Abair | 84/727 |
| 4,686,881 | A | * | 8/1987 | Fender | 84/727 |
| 5,111,728 | A | * | 5/1992 | Blucher et al. | 84/726 |
| 5,354,949 | A | * | 10/1994 | Zwaan | 84/727 |
| 5,378,850 | A | * | 1/1995 | Tumura | 84/727 |

* cited by examiner

*Primary Examiner* — Jeffrey Donels
(74) *Attorney, Agent, or Firm* — Blue Filament Law PLLC; Guy Levi; Avery Goldstein

(57) ABSTRACT

Devices and methods for transducing vibrations of a ferromagnetic string in a musical stringed instrument are provided. Specifically, including those for modulating the timbre of a stringed musical instrument with an electromagnetic pickup independent of loudness, sensitivity and dynamic range.

20 Claims, 2 Drawing Sheets

ELECTROMAGNETIC TRANSDUCER FOR STRINGED INSTRUMENT

BACKGROUND

The present disclosure is directed to an apparatus and method for modulating timbre of a musical instrument stringed with ferromagnetic strings. Specifically, the disclosure is directed to an electromagnetic transducer configured to modulate the timbre of a stringed magnetic instrument by modulating the strength of the magnetic field below the string, without substantially affecting loudness, sensitivity and dynamic range.

Electromagnetic pickups, are used with certain stringed musical instruments, such as electric guitars, form the main character of the sound of the stringed instrument. They affect tonal character, output, and sensitivity by converting string vibrations into electrical signals for subsequent amplification into sound. The pickups typically comprise a magnet system, optionally with one or more permanent magnet elements and one or more magnetic flux conductors made of magnetic or ferromagnetic material to establish a magnetic field within which the strings vibrate, and coils wound on one or more bobbins disposed in the field to generate electrical signals corresponding to flux variations in the field due to the strings' vibrations. These electrical signals are amplified into musical sounds by circuits and equipment that is typical in the art.

The distance from the pickup to the strings determines the strength and sensitivity of the magnetic field acting on the strings, where the output voltage is generated when a string vibrates in the magnetic field. However, a stronger magnetic field may also dampen the vibration of the strings, decreasing sustain and affecting tonal character and/or timbre. Taken to extremes, a very strong magnetic field can cause false harmonics or double notes.

A common complaint regarding the tonality of electric guitars (as well as other electronic stringed instruments) is that the sound produced is too harsh. This harshness is particularly evident at higher pitches. One way of eliminating or reducing the harshness has been to increase the number of turns of wire in the coil or coils (the bobbin). However, doing so also increases the inductance, resistance and capacitance, resulting in a higher impedance of the pickup. This has the undesirable result of reducing the pickup's efficiency (in other words, the ability of the transducer to translate vibration to a discernable electric signal) and dulling the instrument's tonality, especially at the lower pitches.

The sound generated by the pickup apparatus varies in different positions on the stringed instrument both vertically and horizontally along the instrument because of the harmonics created by the vibration. There are variations in tone (the ratio of higher harmonics compared to low), the timbre (the relative strength of different harmonics caused by the position of the nodes of each harmonic) and in the overall level.

Accordingly, it would be beneficial to be able to modulate the timbre of the stringed instrument, whether string-by-string or in total, at a fixed distance of the pickup from the string(s).

SUMMARY OF THE INVENTION

Disclosed, in various embodiments, are pickups for stringed instruments configured to allow modulating the timbre of the output tonality of the stringed instrument independently of sensitivity, dynamic range and loudness.

In an embodiment, provided herein is a method of modulating timbre (e.g., tonal character) in an electromagnetic pickup device for a stringed musical instrument having a fixed distance from the strings, comprising: providing an electromagnetic pickup including a first bobbin operably coupled to the instrument disposed proximate and below the strings and a first coil wrapped around the body of the first bobbin; a first selectively movable magnetic device for generating a magnetic field around the first bobbin; and a movable magnetic flux conductor selectively extending through the bobbin, disposed above the first selectively movable magnetic device, and defining an adjustable gap, the gap configured to be adjusted independently of the distance between the magnetic flux conductor and the ferromagnetic string; positioning the selectively movable magnetic flux conductor at a predetermined distance below the string; and modulating timbre by adjusting the gap between the magnetic flux conductor and the magnetic device without altering the distance between magnetic flux conductor and the string(s).

In another embodiment, provided herein is an electromagnetic pickup device for a stringed musical instrument having a plurality of ferromagnetic strings, comprising: at least a first bobbin, having a first body operably coupled to the instrument disposed proximate and below the strings and a first coil wrapped around said first body, the body has a first housing; a first magnetic device for generating a magnetic field around the first bobbin; and a movable magnetic flux conductor selectively extending through the housing, disposed above the first magnetic device, and defining an adjustable gap, the gap configured to be adjusted independently of the distance between the magnetic flux conductor and the ferromagnetic string.

These and other features of the electromagnetic transducers disclosed herein will become apparent from the following detailed description when read in conjunction with the drawings, which are exemplary, not limiting.

BRIEF DESCRIPTION OF THE FIGURES

A better understanding of the electromagnetic transducer(s), with regard to the embodiments thereof, reference is made to the accompanying drawings, in which like numerals designate corresponding elements or sections throughout and in which.

DETAILED DESCRIPTION OF THE PREFERRED EMBODIMENTS

Figure 1A:
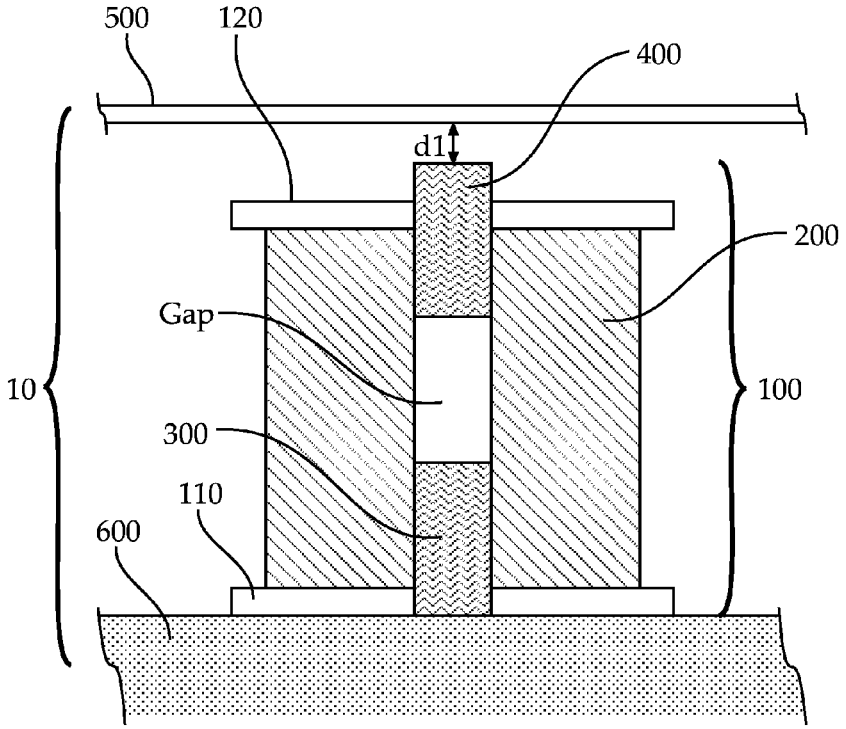
FIG. 1 is an illustration of (1A) a side view of an embodiment of the electromagnetic transducer capable of modulating timbre of a stringed instrument output tonality independently of sensitivity and loudness having a single magnetic device and an adjustable gap with FIG. 1B illustrating a top view of an embodiment with a single magnetic flux conductor and FIG. 1C illustrating a top view of an embodiment of the electromagnetic transducer, with a magnetic flux conductor per string.

Provided herein are embodiments of methods and devices configured to allow modulating the timbre of the output tonality of the stringed instrument independently of sensitivity, dynamic range and loudness.

Tone (referring to the ratio of higher harmonics compared to low) and timbre (referring to the relative strength of different harmonics caused by the position of the nodes of each harmonic) are related terms, but are nevertheless quite different. A ferromagnetic string can produce a combination of frequencies once it is made to vibrate; either by strumming or plucking (e.g., guitars, mandolins, contrabass and the like) or by hitting (e.g., piano). For any string, the note can consist mainly of the pitch corresponding to the picked string (referred to as the fundamental or 1st harmonic), as well as quieter levels of the $2^{nd}$ harmonic (e.g., one octave above the fundamental), and further harmonics. The $3^{rd}$ harmonic can be very close to a lower pitch string, the 4th harmonic is of the same pitch, two octaves above the fundamental, and so on. True harmonics can go to the limit of human hearing, or to the limits of any amplifiers capabilities coupled to the instrument.

Generally, higher level of upper harmonics compared to the lower harmonics and fundamental, produces a brighter, or sharper tone. It is possible to reduce the proportion of higher harmonics by, for example increasing the distance between the pickup and the string. Timbre is typically determined by the relative levels of different harmonics. Variations in timbre on any stringed instrument are produced by a plurality of factors such as; for example, pickup design and position, the natural resonances and damping in the stringed instrument due to the materials used (e.g., wood, resin, metal—each with their own resonant frequencies) and its construction and shape, the gauge composition and age of the strings, playing technique, etc.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

In an embodiment, the term "timbre" refers to the harmonic spectrum of a note, or a characteristic associated with a difference between two tones when the two tones give different impressions although the two tones have an equal loudness and an equal pitch. A "spectral envelope" is known as a physical quantity associated with the timbre. It is not possible, however, to exactly represent the relative amplitudes of harmonic peaks of tones having different pitches by using only one spectral envelope. The timbral characteristics cannot be represented only with such timbral features. Then, as disclosed and claimed herein, the timbral characteristics cannot be understood without analyzing the timbral features and their mutual dependencies. On this assumption, provided herein are electromagnetic transducers and methods that deal with the timbres specific to individual musical instruments by modulating not only the timbral features but also the pitch-dependencies of timbral features while decoupling these features as much as possible from pitch, sensitivity and loudness.

Accordingly and in an embodiment, provided herein is a method of modulating timbre in an electromagnetic pickup device for a musical instrument stringed with ferromagnetic strings, having a fixed distance from the strings, comprising: providing an electromagnetic pickup has a first housing operably coupled to the instrument disposed proximate and below the strings and a first coil wrapped around the first housing forming a bobbin; a first magnetic device for generating a magnetic field around the first bobbin; and a movable magnetic flux conductor selectively extending through the housing, disposed above the first magnetic device, and defining an adjustable gap, the gap configured to be adjusted independently of the distance between the magnetic flux conductor and the ferromagnetic string; positioning the magnetic flux conductor at a predetermined distance below the string; and modulating timbre of the stringed instrument by adjusting the gap between the magnetic flux conductor and the magnetic device without moving the magnetic flux conductor.

The term "modulating" refers in an embodiment to causing an increase or decrease in an air gap present between the magnetic flux conductor, for example, an upper pole piece disposed proximately below the ferromagnetic string and a magnetic device, for example a bar magnet, or magnetized pole piece to change the strength of the magnetic flux created between the magnetic flux conductor and the magnet upon movement of the string to achieve a desired timbre.

The pickup can convert the vibration of a ferromagnetic string into an electrical signal. Pickups typically consist of a magnet and coil arrangement where the strings interact with the magnetic field to induce a voltage in the coil. The magnets can be, for example, a permanent magnet, a ferromagnet, a coil magnet or a combination including one of the foregoing. Permanent magnets can produce a magnetic field because the charges in the magnet are set into a nearly-permanent, complementary oscillatory motion. Alternatively, the ferromagnet, a temporary magnet that can produce a magnetic field. Typically, this magnet does not exhibit a magnetic field, but the magnetic field can be induced by a permanent magnet. In addition, coil magnet refers to a coil through which alternating current flows, which can induce a magnetic field according to the orientation of the winding of the coil, among several other factors (e.g., gauge, number of turns, material, insulation presence and combination including some or all these factors).

The coils used in the methods and electromagnetic transducers used for modulating timbre at a fixed distance of magnetic flux conductors and the ferromagnetic strings, can be wound around the housing of the magnetic device in order to "pickup" changes in the magnetic field. In an embodiment, induction can be used to pick up vibrations of the ferromagnetic strings and transducing these vibrations. In induction, a varying magnetic field induces an electromotive force in a loop (e.g., coil) of wire that counters that change. This electromotive force can manifest as a voltage difference that is equal to the change in flux times a constant of induction, which is linearly proportional to the number of windings that compose the loop (in other words, the coil forming a bobbin). Thus, a sinusoidally varying magnetic field such as that generated by a vibrating ferromagnetic string can induce an electromotive force in the coil that can be nearly perfectly sinusoidal, and by the principle of superposition, any varying signal or repeating waveform induces an equivalent electromotive force in the coil. This voltage can then be amplified and modulated as desired.

In an embodiment, the term "transducer" refers to any device that converts one physical attribute to another for the purpose of creating sound, for example electromagnetic or optical devices and/or receivers as well as transmitters.

In an embodiment, the electromagnetic transducer can comprise a pair of magnets resting on a support plate whose distance from the strings can be adjusted. Magnetic legs (in other words, electromagnetic flux conductors) extend a set of coils, which picks up the vibrations through induction. The pickup can be embedded into the guitar and be coupled thereto, which is adjustable. The magnets are independently adjustable and define an adjustable air gap therebetween. In an embodiment, the magnet below and proximal to the strings can be the same or different than the magnet closer to than base plate of the transducer (in other words, the base magnet), which can be coupled to the body of the stringed instrument. For example, the base magnet can be a rare earth magnet; for example Neodymium permanent magnet while the magnet proximate to the strings can be AlNiCo magnet. In addition, the adjustable gap can be the same or different along the magnet which can extend along the width of the strings and be increased or decreased below the treble side of the strings towards the base side of the strings.

In another example, the electromagnetic transducer can comprise one magnetic flux conductor for each string that is wrapped by a coil, each above an adjustable magnet which provides the necessary flux change and defining a gap between each magnetic flux conductor and each magnet. These magnetic flux conductors can be moved up and down in order to adjust the amplitudes (in other words, loudness and/or sensitivity and/or dynamic range) of each string. Adjusting the gap between the magnet(s) and the respective magnetic flux will change the strength of the magnetic flux picked up by the coils, thus modulating timbre of that string independently of the amplitude set by the distance of the magnetic flux conductor and the pitch, set by the string type and the location of the pickup along the string (in other words, fret, bridge etc.).

In yet another example, the electromagnetic transducer can comprise one large flat coil as the inductor to transduce the vibrations. Below each string is an adjustable steel magnetic flux conductor which acts as a pole piece. the adjustable height pole pieces can be made for example, from mild steel and be plated with nickel serve to conduct the magnetic field of the bar magnets up though the center of the pickup coil and allow this field to return to the opposite end of the bar magnets after passing though the coil windings. The two flat bar magnets can lie under the coil. As indicated above, the magnets can be the same or different and define an adjustable gap between the magnets. The pole pieces are each adjusted to the desired distance below each ferromagnetic string as described above, followed by modulating the timbre of the instrument by adjusting the gap between the magnets.

Also, the electromagnetic transducer can be a hum-eliminating pickup has two sets of coil windings in addition to the pickups described above or their combination, located next to each other and under the ferromagnetic strings. Both coils can be perturbed by plucked strings; however, the coiled are out of phase (in other words, wound in opposite directions, have different gauge coils, having different number of windings, are made from a different metal, have different amount and type of insulation, or a combination thereof). The plucking of the string can be amplified, but background interference, from lights, other instruments or from the AC sources, induces canceling electromotive forces.

Accordingly, provided herein is an electromagnetic pickup device for a stringed musical instrument having a plurality of ferromagnetic strings, comprising: at least a first bobbin, having a first body operably coupled to the instrument disposed proximate and below the strings and a first coil wrapped around said first body, the body a first housing; a first magnetic device for generating a magnetic field around the first bobbin; and a movable magnetic flux conductor selectively extending through the housing, disposed above the first magnetic device, and defining an adjustable gap, the gap configured to be adjusted independently of the distance between the magnetic flux conductor and the ferromagnetic string.

The term "coupled", including its various forms such as "operably coupling", "coupling" or "couplable", refers to and comprises any direct or indirect, structural coupling, connection or attachment, or adaptation or capability for such a direct or indirect structural or operational coupling, connection or attachment, including integrally formed components and components which are coupled via or through another component or by the forming process. Indirect coupling may involve coupling through an intermediary member or adhesive, or abutting and otherwise resting against, whether frictionally or by separate means without any physical connection.

The electromagnetic device used in the methods and electromagnetic transducers used for modulating timbre at a fixed distance of magnetic flux conductor(s) and the ferromagnetic strings can be a pole piece selectively movable in the housing. The term "selectively movable" refers to the electromagnetic device being movable in the housing such that its motion is not necessary for the function of the pickup and the degree of motion can be controlled by the user to modulate timbre. In other words, the term "selectively" when used in the specification or the claims, refer to a condition of a component wherein a user of the device may activate or deactivate the feature or function of the component as is necessary or desired in use of the device. The electromagnetic device can be a pole piece having a polarity that is opposite to the polarity of the magnetic flux conductor, itself which could be a pole piece. In addition, the term "magnetic flux conductor" can refer to an elongated structure composed of magnetically permeable material. Optionally, a magnetic flux conductor can have grain orientation along a longitudinal direction (i.e., lengthwise). Examples of magnetic flux conductors can be screws, wires, laminations or their combination, composed of magnetically permeable material, such as silicon steel.

Likewise, the pole-pieces when using single coil pickups can be individual magnets configured to provide focused magnetic field, capable of sensing a small section of the string vibration. Conversely, in another example, using screws in the humbucking pickup as described herein can conduct the magnetic field from a magnet placed underneath the pickup at an adjustable gap. There can be another set of magnetically conductive adjustable slugs in the other coil, which can be selectively adjustable to provide the timbre modulation, so the combined Humbucker pickup reads a larger length of string vibration.

In an embodiment, the housing used in the methods and electromagnetic transducers used for modulating timbre can define a plurality of bores (in other words, holes) that can correspond to the number of strings in the instrument. Each hole or bore can have a magnetic flux conductor extending through the bore to below the string; and an electromagnetic device (e.g., a magnet) that is a selectively movable pole piece within the bore. The pole piece can, for example, be a magnetic slug and the magnetic flux conductor can be a can be an individual magnet, a screw, or other suitable magnetic flux conductor. The adjustable gap is defined between the selectively movable pole piece and the selectively movable magnetic flux conductor, such that the distance between the magnetic flux conductor and the string can be adjusted separately and independently from the adjustments of the gap carried out by selectively moving the pole piece within each bore. In an embodiment, the gap between the pole piece and the magnetic flux conductor is zero (in other words, the magnetic flux conductor and the pole piece abut each other (i.e. touch)), and the full strength of the electromagnetic device is transduced by the vibrating string.

In an embodiment, the gap between the electromagnetic device or the magnet and the magnetic flux conductor allows the use of magnets capable of producing much stronger magnetic field than typically used in current pickups, without compromising tone and timbre and without forcing the user to change magnets when different timbre and tone is desired. Magnet types that could be used in the pickups described herein can be: AlNiCo-II, AlNiCo-III, AlNiCo-IV, AlNiCo-V, ceramic magnet types, neodymium magnet alloys (e.g., Neodymium-Iron-Boron ($Nd_2Fe_{14}B$) alloy, sometimes referred to as "Neo" magnets) and samarium-cobalt alloys (e.g., $Sm_2Co_{17}$, or SmCo Series 2:17). Accordingly, in an embodiment, the magnet used in the methods and devices described herein can have energy products ($BH_{max}$) that range from about 3 megagauss-oersteds (MGOe) to about 35MGOe, without substantially affecting sustain (referring to the reverberation time length used to produce the harmonics) of the string. For example the magnetic device(s) can have $BH_{max}$ between about 5MGOe and about 32MGOe, or between about 7MGOe and about 20MGOe, specifically between about 10MGOe and about 32 MGOe, or between about 12MGOe and about 30MGOe.

In an embodiment, provided herein is an electromagnetic pickup device for a stringed musical instrument having a plurality of ferromagnetic strings, comprising: at least a first bobbin, having a first body operably coupled to the instrument disposed proximate and below the strings and a first coil wrapped around said first body, the body has a first housing; a first magnetic device for generating a magnetic field around the first bobbin; and a movable magnetic flux conductor selectively extending through the housing, disposed above the first magnetic device, and defining an adjustable gap, the gap configured to be adjusted independently of the distance between the magnetic flux conductor and the ferromagnetic string and a second bobbin, having a second body operably coupled to the instrument disposed adjacent to the first body and a second coil wrapped around said second body, the body has a second housing; a second magnetic device for generating a magnetic field around the second bobbin; and a movable magnetic flux conductor selectively extending through the housing, disposed above the first magnetic device, and defining an adjustable gap, the gap configured to be adjusted independently of the distance between the magnetic flux conductor and the ferromagnetic string, wherein the coil of the second bobbin is wound in the opposite direction and/or has different number of turns than the coil of the first bobbin, has a different gauge than the gauge of the coil in the first bobbin, or a combination thereof making the coil in the second bobbin be out-of-phase with the windings of the first bobbin.

A more complete understanding of the components, processes, methods and devices disclosed herein can be obtained by reference to the accompanying drawings. These figures (also referred to herein as "FIG.") are merely schematic representations based on convenience and the ease of demonstrating the present disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Turning now to FIG. 1, (side view in 1A and top view in 1B) illustrating an embodiment of the devices disclosed as electromagnetic pickup device 10 for a stringed musical instrument having a plurality of ferromagnetic strings, the device having bobbin 100, face plate 120 and base plate 110 operably coupled to instrument body 600, the bobbin disposed proximate and below string 500 with coil 200 wrapped around the body of bobbin 100, with selectively movable magnetic device 300 for generating a magnetic field around bobbin 100; and movable magnetic flux conductor 400 selectively extending through bobbin 100 and above face plate 120, disposed above magnetic device 300, defining adjustable gap, the gap configured to be adjusted independently of distance $d_1$ between magnetic flux conductor 400 and ferromagnetic string 500. To modulate timbre, the distance $d_1$ between magnetic flux conductor 400 and string 500 is set at a predetermined distance d1, followed by selectively modulating the timbre of the instrument by adjusting gap between selectively movable magnetic device 300 and magnetic flux conductor 400.

Figure 1B:
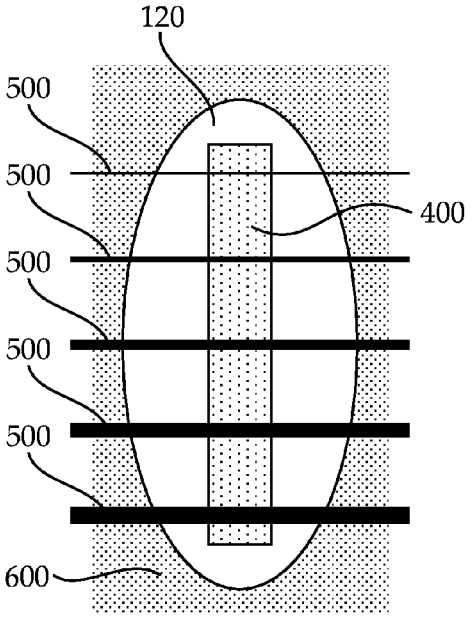
Figure 1C:
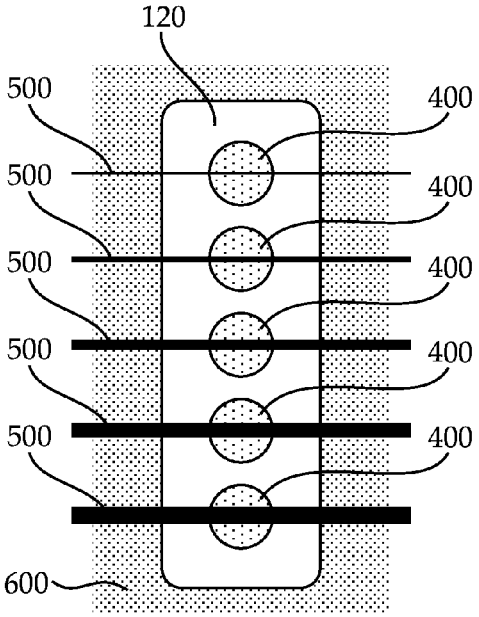

As illustrated in FIG. 1B, pickup 10 can be configured to provide a different distance d1 along the length of magnetic flux conductor from, for example high E to low E, while magnetic device 300 can be adjusted to similarly provide an increasing gap, decreasing gap or same gap from high E to low E (in an example). Similarly, as illustrated in FIG. 1C, magnetic flux conductor 400 can be a selectively movable pole piece specific for each string and be set at desired distance $d_1$ from each string 500. Magnetic device 300 can be a single bar spanning the width of base plate 110 (not shown) and be selectively movable as a unit or selectively from each side (e.g., low E and high E), or in another embodiment, have separate selectively movable magnetic devices 300 aligned with and below selectively movable magnetic flux conductor 400 thereby providing an adjustable gap for each string 500.

Figure 2:
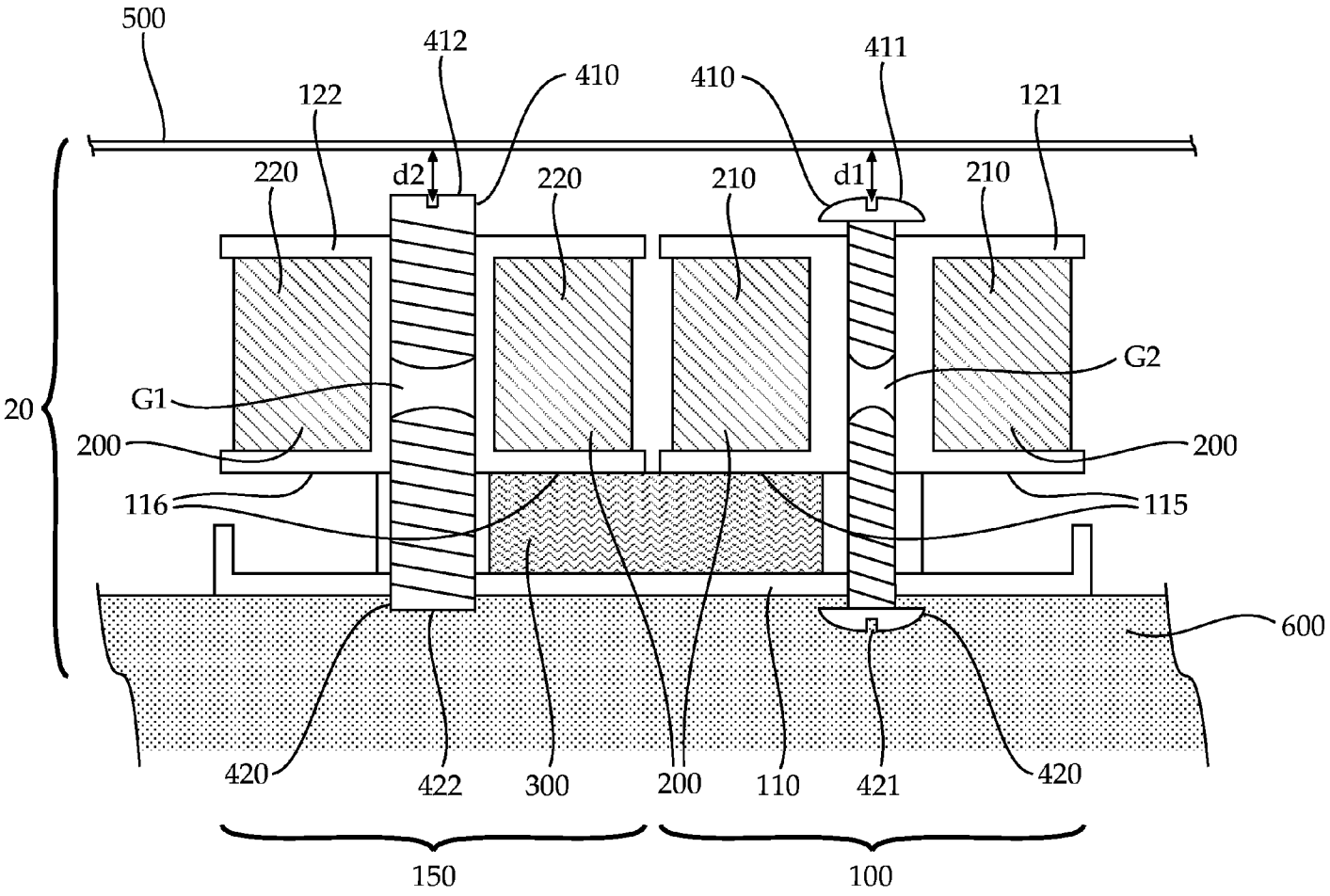
FIG. 2, is an illustration of an embodiment of the electromagnetic transducer capable of modulating timbre of a stringed instrument output tonality independently of sensitivity and loudness having a plurality of magnetic flux conductors and pole pieces as magnetic devices.

Turning now to FIG. 2, illustrating a humbucking pickup according to the disclosure where, electromagnetic pickup device 20 comprises first bobbin 100, having base plate 110 operably coupled to instrument body 600 with face plate 121 disposed proximate and below strings 500 and coil plate 115 providing support for first coil 210 wrapped around the body of the first bobbin 100, with magnetic device 300 for generating a magnetic field around first bobbin. Also shown is first selectively movable pole piece 411 of magnetic flux conductor 410 extending through the face plate 121 of bobbin 100, disposed above selectively first movable magnetized pole piece 421 (e.g., a nickel coated steel screw) extending from magnetic device 300, and defining an adjustable gap$G_1$, $G_1$ can be configured to be adjusted independently of distance $d_1$ between first pole piece 411 of selectively movable magnetic flux conductor 410 and ferromagnetic string 500. Humbucking pickup 20 can further comprise second bobbin 150, disposed adjacent to first bobbin 100, having base plate 110 operably coupled to instrument body 600 with face plate 122 disposed proximate and below strings 500 and second coil plate 116 providing support for second coil 220 wrapped around the body of the second bobbin 150, with magnetic device 300 for generating a magnetic field around second bobbin 150. Also shown is second selectively movable slug 412 of magnetic flux conductor 410 extending through face plate 122 of bobbin 150, disposed above selectively second movable magnetized slug 422 extending from magnetic device 300, and defining adjustable gap $G_2$, $G_2$ configured to be adjusted independently of distance $d_2$ between slug 412 of selectively movable magnetic flux conductor 410 and ferromagnetic string 500.

Coil 210 and 220 can be out of phase, by having different number of coil windings, be made of different materials, be of different gauge, be wound in opposite direction (e.g., 220 counter-clock-wise and 210 clock-wise), have different insulation or a combination thereof. Likewise, gaps $G_1$ and $G_2$ and distance $d_1$ and $d_2$ can be the same or different. Modulating timbre can be done by adjusting each of pole piece 411 of magnetic flux conductor 410 and independently modulating $G_1$ by selectively moving pole piece 421 extending through magnetic device 300.

Accordingly, provided herein is a method of modulating timbre in an electromagnetic pickup device for a stringed musical instrument having a fixed distance from the strings, comprising: providing an electromagnetic pickup includes a first bobbin operably coupled to the instrument disposed proximate and below the strings and a first coil wrapped around the body of said first bobbin; a first selectively movable magnetic device for generating a magnetic field around the first bobbin; and a selectively movable magnetic flux conductor extending through the bobbin, disposed above the selectively movable first magnetic device, and defining an adjustable gap, the gap configured to be adjusted independently of the distance between the magnetic flux conductor and a ferromagnetic string; positioning the magnetic flux conductor at a predetermined distance below the string; and modulating timbre by adjusting the gap between the magnetic flux conductor and the magnetic device without changing the distance below the string, wherein (i) the selectively movable electromagnetic device is a pole piece selectively movable in the first bobbin, (ii) the adjustable gap is between the selectively movable magnetic flux conductor and the selectively movable pole piece, (iii) the step of modulating the timbre comprises vertically moving the selectively movable pole piece within the first bobbin, wherein (iv) the body of the bobbin defines a plurality of bores corresponding to the number of strings in the instrument, each having a selectively movable magnetic flux conductor extending through the bore and a selectively movable electromagnetic device that is a selectively movable pole piece within the bore, (v) the adjustable gap is between each of the magnetic flux conductors and each pole pieces within each bore, (vi) the step of modulating the timbre comprises vertically moving the selectively movable pole piece within the bore, without changing the distance between each selectively movable magnetic flux conductor below each string, and wherein (vii) the narrower the gap between the magnetic flux conductor and the magnetic device, the greater is the shift from warm, smooth, thick or fat tones towards clear, harsh, bright, or light tones.

In another embodiment, provided herein is an electromagnetic pickup includes a first bobbin operably coupled to the instrument disposed proximate and below the strings and a first coil wrapped around the body of said first bobbin; a first selectively movable magnetic device for generating a magnetic field around the first bobbin; and a first selectively movable magnetic flux conductor extending through the first bobbin, disposed above the first selectively movable magnetic device, and defining an adjustable gap, the gap configured to be adjusted independently of the distance between the first magnetic flux conductor and (a) ferromagnetic string(s), wherein (viii) the selectively movable electromagnetic device is a pole piece selectively movable in the first bobbin, (ix) the magnetic device produce energy products ($BH_{max}$) ranging between about 12 megagauss-oersteds (MGOe) and about 35 MGOe, (x) the gap between the selectively movable pole piece and the selectively movable magnetic flux conductors is configured to be adjusted by moving the pole piece within the bobbin, without changing the distance of the selectively movable magnetic flux conductor below the ferromagnetic string(s), wherein (xi) the body of the bobbin defines a plurality of bores corresponding to the number of strings in the instrument, each having a selectively movable magnetic flux conductor extending through the bore and a selectively movable electromagnetic device that is a selectively movable pole piece within the bore, (xii) the adjustable gap is between each selectively movable magnetic flux conductor and each selectively movable pole piece within each bore, the device (xiii) configured to enable modulating timbre independent of the distance between the selectively movable magnetic flux conductor(s) and the ferromagnetic string(s), the device (xiv) further includes a second bobbin disposed adjacent to and in communication with the first bobbin and is operably coupled to the instrument the second bobbin disposed proximate and below the strings and a second coil wrapped around the body of said second bobbin; a selectively movable magnetic device for generating a magnetic field around the second bobbin; and a second selectively movable magnetic flux conductor extending through the second bobbin, disposed above the selectively movable magnetic device, and defining an adjustable gap, the gap configured to be adjusted independently of the distance between the second selectively movable magnetic flux conductor and the ferromagnetic string(s), wherein the coil of the second bobbin is wound in the opposite direction and/or has different number of turns than the coil of the first bobbin, has a different gauge than the gauge of the coil in the first bobbin, or a combination thereof making the coil in the second bobbin be out-of-phase with the first bobbin, (xv) the selectively movable magnetic device for generating a magnetic field around the second bobbin is a second selectively movable magnetic device, (xvi) the second selectively movable magnetic device is a pole piece, selectively movable within the body of the second bobbin, wherein (xvii) the housing defines a plurality of bores corresponding to the number of ferromagnetic strings in the instrument, each bore having a magnetic flux conductor extending through the bore and an electromagnetic device that is a selectively movable pole piece within the bore, wherein the adjustable gap is between each selectively movable magnetic flux conductor(s) and each selectively movable pole piece(s) within each bore.

In yet another embodiment; provided herein is (xviii) a stringed musical instrument includes the pickup devices described herein, wherein (xix) the stringed instrument is a guitar, bass, mandolin, violin, cello viola, harp, ukulele, contrabass and the like.

The terms "first," "second," and the like, herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the string(s) includes one or more strings). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

The term "plurality", as used herein, is defined as two or as more than two. The term "another", as used herein, is defined as at least a second or more. The terms "including" and/or "having", as used herein, are defined as comprising per the appended claims (i.e., open language).

The term "communication" and its derivatives (e.g., "in communication") may refer to a shared bus configured to allow communication between two or more devices, or to a point to point communication link configured to allow communication between only two (device) points.

While particular embodiments have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents.

What is claimed:

1. A method of modulating timbre in an electromagnetic pickup device for a stringed musical instrument having at least one ferromagnetic string and a fixed distance from the at least one string, comprising:

(a) providing an electromagnetic pickup comprising a first bobbin operably coupled to the instrument disposed proximate and below the strings and a first coil wrapped around the body of said first bobbin; a first selectively movable magnetic device for generating a magnetic field around the first bobbin; and a selectively movable magnetic flux conductor extending through the bobbin, disposed above the selectively movable first magnetic device, and defining an adjustable gap, the gap configured to be adjusted independently of the distance between the magnetic flux conductor and the at least one string;

(b) positioning the first selectively movable magnetic flux conductor at a predetermined distance below the at least one string; and (c) modulating timbre by adjusting the gap between the magnetic flux conductor and the magnetic device without changing the distance between the first magnetic flux conductor and the at least one string.

2. The method of claim 1, wherein the selectively movable electromagnetic device is a pole piece selectively movable in the first bobbin.

3. The method of claim 2, wherein the adjustable gap is between the magnetic flux conductor and the pole piece.

4. The method of claim 3, wherein the step of modulating the timbre comprises vertically moving the selectively movable pole piece within the first bobbin.

5. The method of claim 1, wherein the body of the bobbin defines a plurality of bores corresponding to the number of strings in the instrument, each having a selectively movable magnetic flux conductor extending through the bore and an electromagnetic device that is a selectively movable pole piece within the bore.

6. The method of claim 5, wherein the adjustable gap is between each magnetic flux conductor and each pole piece within each bore.

7. The method of claim 6, wherein the step of modulating the timbre comprises vertically moving the selectively movable pole piece within the bore without changing the distance between each selectively movable magnetic flux conductor below each string.

8. The method of claim 1, wherein the narrower the gap between the magnetic flux conductor and the magnetic device, the greater is the shift toward the treble tones.

9. An electromagnetic pickup for a ferromagnetic string comprising:

(a) a first bobbin operably coupled to the instrument disposed proximate and below the strings and a first coil wrapped around the body of said first bobbin;

(b) a first selectively movable magnetic device for generating a magnetic field around the first bobbin; and (c) a selectively movable magnetic flux conductor extending through the bobbin, disposed above the selectively movable first magnetic device, and defining an adjustable gap, the gap configured to be adjusted independently of the distance between the first selectively movable magnetic flux conductor and the string.

10. The pickup device of claim 9, wherein the first selectively movable electromagnetic device is a pole piece selectively movable in the first bobbin.

11. The pickup device of claim 10, wherein the magnetic device produce energy products ($BH_{max}$) ranging between about 12 megagauss-oersteds (MGOe) and about 35 MGOe.

12. The pickup device of claim 11, wherein the gap between the first selectively movable pole piece and the first magnetic flux conductor is configured to be adjusted by moving the pole piece within the body of the first bobbin, without changing the distance between the first selectively movable magnetic flux conductor and the string.

13. The pickup device of claim 9, wherein the body of the first bobbin defines a plurality of bores corresponding to the number of strings in the instrument, each having a selectively movable magnetic flux conductor extending through the bore and an electromagnetic device that is a selectively movable pole piece within the bore.

14. The pickup device of claim 13, wherein the adjustable gap is between each selectively movable magnetic flux conductor and each selectively movable pole piece within each bore.

15. The pickup device of claim 9, configured to enable modulating timbre independent of the distance between the first selectively movable magnetic flux conductor and the ferromagnetic string.

16. A stringed musical instrument comprising:

the pickup device of claim 9; and a tensioned ferromagnetic string.

17. The pickup device of claim 9, further comprising:

(a) a second bobbin disposed adjacent to and in communication with the first bobbin and is operably coupled to the instrument, wherein the second bobbin disposed proximate and below the strings;

(b) a second coil wrapped around the body of said second bobbin;

(c) a selectively movable magnetic device for generating a magnetic field around the second bobbin; and (d) a second selectively movable magnetic flux conductor extending through the second bobbin, disposed above the selectively movable magnetic device, and defining an adjustable gap, the gap configured to be adjusted independently of the distance between the second selectively movable magnetic flux conductor and the ferromagnetic string, wherein the coil of the second bobbin is wound in the opposite direction and/or has different number of turns than the coil of the first bobbin, has a different gauge than the gauge of the coil in the first bobbin, or a combination thereof making the coil in the second bobbin be out-of-phase with the first bobbin.

18. The pickup of claim 17, wherein the selectively movable magnetic device for generating a magnetic field around the second bobbin is a second selectively movable magnetic device.

19. The pickup of claim 18, wherein the second selectively movable magnetic device is a pole piece, selectively movable within the body of the second bobbin.

20. The pickup device of claim 19, wherein the body of the second bobbin defines a plurality of bores corresponding to the number of ferromagnetic strings in the instrument, each bore having a selectively movable magnetic flux conductor extending through the bore and an electromagnetic device that is a selectively movable pole piece within the bore, wherein the adjustable gap is between each selectively movable magnetic flux conductor and each selectively movable pole piece within each bore.

* * * * *